US008117826B1

(12) United States Patent
Howard

(10) Patent No.: US 8,117,826 B1
(45) Date of Patent: Feb. 21, 2012

(54) EXTERNAL COMBUSTION ENGINE WITH ROTARY PISTON CONTROLLED VALVE

(76) Inventor: Kenneth W. Howard, DeKalb, TX (US)

( * ) Notice: Subject to any disclaimer, the term of this patent is extended or adjusted under 35 U.S.C. 154(b) by 29 days.

(21) Appl. No.: 12/763,608

(22) Filed: Apr. 20, 2010

(51) Int. Cl.
*F02G 1/02* (2006.01)
*F02G 1/06* (2006.01)

(52) U.S. Cl. ..... 60/39.6; 60/39.62

(58) Field of Classification Search ..... 60/39.6, 60/39.62
See application file for complete search history.

(56) References Cited

U.S. PATENT DOCUMENTS

| | | | | | |
|---|---|---|---|---|---|
| 939,751 | A * | 11/1909 | Schulz | 60/39.62 |
| 1,846,298 | A * | 2/1932 | Alcznauer | 60/39.54 |
| 3,040,531 | A * | 6/1962 | Yalnizyan | 60/39.62 |
| 3,873,245 | A * | 3/1975 | Doshi | 418/5 |
| 3,954,355 | A * | 5/1976 | Paul, Jr. | 418/9 |
| 4,015,424 | A * | 4/1977 | Shinohara | 60/39.6 |
| 4,646,693 | A * | 3/1987 | Fayngersh et al. | 60/39.62 |
| 4,782,656 | A * | 11/1988 | Hansen | 60/39.6 |
| 4,820,480 | A * | 4/1989 | David | 418/153 |
| 5,522,356 | A * | 6/1996 | Palmer | 60/39.6 |
| 6,397,579 | B1 * | 6/2002 | Negre | 60/39.6 |
| 8,037,670 | B2 * | 10/2011 | Ikemura | 60/39.6 |
| 2007/0199299 | A1 * | 8/2007 | Kashmerick | 60/39.6 |
| 2008/0216792 | A1 * | 9/2008 | Hartfield | 123/213 |

* cited by examiner

*Primary Examiner* — Mary A Davis
(74) *Attorney, Agent, or Firm* — Jack D. Stone, Jr.; Scheef & Stone, L.L.P.

(57) ABSTRACT

The present invention provides an engine comprising a housing that defines a chamber. The engine also includes a driveshaft positioned within the housing such that the driveshaft extends from the chamber and passes through a wall of the housing such that devices may couple to the engine. The engine includes a rotatable piston positioned within the housing, coupled to the driveshaft, and configured to rotate about the driveshaft axis. A backstop valve couples to the housing such that the backstop valve directs expansive gas toward the rotatable piston. The housing further defines an exhaust outlet configured to exhaust used expansive gas. Finally, the engine includes ignition and timing controls coupled to the housing and configured to combust a fuel.

20 Claims, 8 Drawing Sheets

200
214
114
210
150
208
209
205
204
201
150
203
107
140
106
150
218
150
140

EXTERNAL COMBUSTION ENGINE WITH ROTARY PISTON CONTROLLED VALVE

TECHNICAL FIELD

The invention relates generally to mechanical engines and, more particularly, to combustion engines.

BACKGROUND

Modern society bases most of its transportation infrastructure on the internal combustion engine. From automobiles to airplanes, the internal combustion engine drives much of commerce. Generally, the internal combustion engine uses the combustion of a fuel source with an oxidizer to generate gases under high pressure. The design of most internal combustion engines direct these gases against a mechanical component. This causes the mechanical component to move, converting the combustion process into mechanical energy harnessed to perform work. These engines can vary greatly in size and be used in numerous applications.

A cycle consisting of four events generally describes the basic operation of an internal combustion engine. These events are intake, compression, power (ignition), and exhaust. During intake, a fuel source, such as gasoline, and an oxidizer, such as air, are drawn into, or pumped into, a combustion chamber through valves operated by a camshaft. The two combustible ingredients, the fuel source and the oxidizer, mix within the combustion chamber. Next, compression occurs. During compression, the combustible ingredients are placed under pressure. Usually a piston, the maximum range of motion of which is controlled by a crankshaft to which the piston is attached, moves into the combustion chamber, decreasing the volume of the combustion chamber and placing the fuel source and oxidizer under great pressure. At the point of greatest compression, an igniter, such as a spark from a spark plug, ignites the combustible ingredients causing the rapid conversion of the combustible ingredients into a rapidly expanding gas. This rapidly expanding gas generates a force against the piston causing the piston to move in a manner that increases the volume of the combustion chamber. It is this motion that generates mechanical energy harnessed through the crankshaft and other components. Finally, the piston reaches the maximum range of expansion as determined by the crankshaft. As the crankshaft turns it pushes the piston back into the combustion chamber where the combustion gases exhaust through a valve opened through operation of the camshaft. In different variations of the internal combustion engine, the events can be combined in certain specific ways to create engines that better fit certain applications.

As ubiquitous as the internal combustion engine is, it also suffers from some serious drawbacks. For example, because the internal combustion engine must operate at high pressures, the components must be extremely strong, necessitating heavy overbuilt components, or lightweight expensive components. Heavy components decrease the efficiency and use of the engine, and lightweight components drive up the cost of the engine limiting, the number of applications to which it can reasonably be applied. Thus, there is a need for a combustion engine that does not need to operate at such high pressures.

The high pressures can also necessitate that the engines be finely tuned, and limited to one particular type of fuel so that a specific pressure, fuel, and oxidizer must be used at all times. This limits the applications to which any individual engine can be placed. Furthermore, it increases the dependence of the those using the engine on a particular fuel source.

Thus, there is a need for combustion engines, where a user can easily convert any individual engine to run on multiple fuel sources depending on what is available, and the type of work that is to be performed.

Finally, regardless of the type of components, internal combustion engines must operate a crankshaft and camshaft assembly to successfully complete the engine cycle that generates power. Operation of these components is necessary to continue the operation of the engine; yet, with each cycle, power that could otherwise be directed to the purpose of the engine is leached by these components. This decreases the engine's efficiency and drives up the cost of operation through increased fuel costs. Thus, there is a need for a combustion engine that decreases efficiency losses due to components such as the crankshaft and camshaft.

SUMMARY

The present invention, accordingly, provides an external combustion engine comprising a first engine housing defining a first engine chamber, wherein the first engine chamber comprises a space for containing and directing expansive gas generated by combustion of a fuel. The invention includes a combustion chamber coupled to the first engine housing such that expanding gas produced by combustion of a fuel passes from the combustion chamber into the first engine housing through a combustion gas inlet. The engine also includes a driveshaft positioned within the first engine housing such that the driveshaft extends from a center of the first engine housing and passes through a wall of the first engine housing such that devices may couple to the external combustion engine by means of the driveshaft. The driveshaft rotates about a driveshaft axis passing lengthwise through a center of the driveshaft. The engine includes a first rotatable piston positioned within the first engine housing, coupled to the driveshaft, and configured to rotate about the driveshaft axis when expansive gas resulting from combustion of a fuel contacts the first rotatable piston. A first backstop valve couples to the first engine housing such that the first backstop valve directs expansive gas resulting from combustion of a fuel toward the first rotatable piston. The first engine housing further defines a first exhaust outlet configured to exhaust used expansive gas resulting from combustion of a fuel. Finally, the engine includes ignition and timing controls coupled to the first engine housing and configured to combust a fuel.

Yet another embodiment of the invention provides an external combustion engine comprising a first engine housing defining a first engine chamber, wherein the first engine chamber comprises a space for containing and directing expansive gas generated by combustion of a fuel. The engine also includes at least one combustion chamber coupled to the first engine housing such that expanding gas produced by combustion of a fuel passes from the combustion chamber into the first engine housing through a combustion gas inlet. The engine includes a driveshaft positioned within the first engine housing such that the driveshaft extends from a center of the first engine housing and passes through a wall of the first engine housing such that devices may couple to the external combustion engine by means of the driveshaft. The driveshaft rotates about a driveshaft axis passing lengthwise through a center of the driveshaft. At least one first rotatable piston is positioned within the first engine housing, coupled to the driveshaft, and configured to rotate about the driveshaft axis when expansive gas resulting from combustion of a fuel contacts the at least one first rotatable piston. At least one first backstop valve couples to the first engine housing such that the at least one first backstop valve directs expansive gas resulting from combustion of a fuel toward the first rotatable piston, wherein the first engine housing further defines at least one exhaust outlet configured to exhaust used expansive gas resulting from combustion of a fuel. Finally, the engine includes ignition and timing controls coupled to the first engine housing and configured to combust a fuel.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. Additionally, for the most part, details concerning the means by which a fuel source and oxidizer are introduced into the engine and the like have been omitted inasmuch as such details are not considered necessary to obtain a complete understanding of the present invention, and are considered to be within the skills of persons of ordinary skill in the relevant art.

Figure 1:
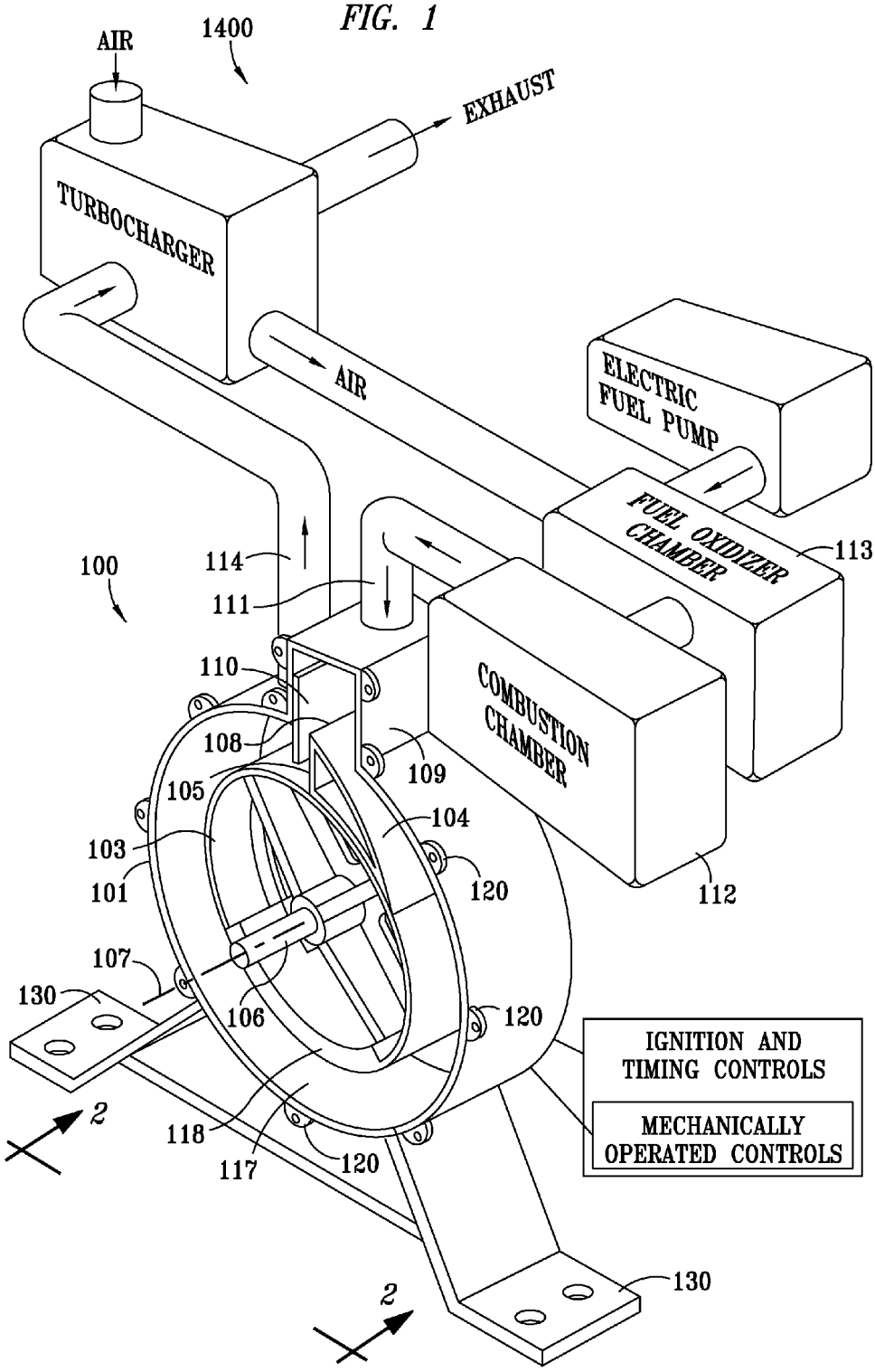
FIG. 1 is a perspective view of an external combustion engine embodying features of the present invention.

Referring to FIG. 1 of the drawings, an engine 100 comprises a first engine housing 101. The first engine housing 101 defines an engine chamber in which additional components of the engine 100 reside and allows those components to move in a rotational manner, as described in more detail below. A person of ordinary skill in the relevant art will understand that the first engine housing 101 may vary in shape and size provided that the first engine housing 101 defines a cavity in which appropriately sized components may operate as described herein. Furthermore, a person of ordinary skill will understand that the first engine housing 101 may be produced of a variety of materials provided that those materials are selected to appropriately accommodate any desired fuel sources with which the engine 100 is used.

The engine 100 further comprises a first rotatable piston 103. In the illustrated embodiment, the driveshaft 106 is positioned near a center of the first engine housing 101 such that the driveshaft 106 may turn on a driveshaft axis 107 passing through a length of the driveshaft 106, as illustrated in FIG. 1. The first rotatable piston 103 couples to the driveshaft 106 such that rotation of the first rotatable piston 103 induces rotation in the driveshaft 106 about the driveshaft axis 107. The first rotatable piston 103 may vary in diameter. Preferably, a gap remains between the first rotatable piston 103 and the first engine housing 101.

The first rotatable piston 103 comprises a first piston riser 104, and a first piston riser head 105. The first piston riser 104 couples to the first rotatable piston 103 and substantially fills the gap between the first rotatable piston 103 and the first engine housing 101. The first piston riser head 105 comprises a portion of the first piston riser 104 configured to receive a force generated by the combustion of a fuel and an oxidizer (described in more detail below). The first piston riser head 105 comprises a first piston riser head edge 108. The first piston riser 104 couples to the first rotatable piston 103 such that the first piston riser head edge 108 contacts the first engine housing 101, or a seal (not shown) between the first engine housing 101 and the first piston riser head edge 108 preventing the passage of gases and other materials between the first piston riser head edge 108 and the first engine housing 101. For ease of explanation, only one piston riser is shown in FIG. 1. A person of ordinary skill in the art will understand that multiple piston risers may couple to the first rotatable piston 103.

The first engine housing 101 further comprises a combustion gas inlet chamber 109. The combustion gas inlet chamber 109 comprises a portion of the first engine housing 101 configured to direct combustion gases toward the first piston riser head 105. The combustion gas inlet chamber 109 may vary in size and location according to the use to which the engine 100 is put. The combustion gas inlet chamber 109 further comprises a first backstop valve 110. In the illustrated embodiment, the first backstop valve 110 comprises a rigid flap hinged at one end so that the first backstop valve 110 will extend into the portion of the first engine housing 101 where the rotatable piston 103 resides. Preferably, an edge of the first backstop valve 110 will contact the first rotatable piston 103 or a seal (not shown) between the first backstop valve 110 and the first rotatable piston 103 when the first piston riser 104 is not causing the operation of the first backstop valve 110 as described below. The first backstop valve 110 displaces into the combustion gas inlet chamber allowing the first piston riser 104 to rotate about the driveshaft axis 107 in the first engine housing 101.

A combustion gas inlet 111 couples to the combustion gas inlet chamber 109. The combustion gas inlet 111 further couples to the combustion chamber 112. As illustrated, the combustion chamber 112 comprises an enclosure in which a fuel and an oxidizer combust, generating combustion gases. The combustion chamber 112 is further coupled by any suitable means to fuel and oxidizer tanks embodied here by fuel/oxidizer chamber 113. A person of ordinary skill in the art will understand that the fuel and the oxidizer enter the combustion chamber through any suitable means. For example, an oxidizer, such as air, could be taken into the engine 100 from the ambient environment utilizing the vacuum pressure generated by the operation of the engine 100. Alternatively, air could be taken from the ambient environment and pressurized through a turbocharger or supercharger prior to entry into the engine 100. Similarly, fuel could be pumped from a fuel tank by means of an electric fuel pump.

A first exhaust outlet 114 couples to the first engine housing 101. The first exhaust outlet 114 provides a pathway for combustion gases to exit the first engine housing 101 following the completion of the engine cycle (described in more detail below). A first engine housing plate (not shown) couples to the first engine housing 101 at engine housing flanges 120. In this manner, the presently exposed interior of the first engine housing 101 is sealed from the atmosphere preventing the dissipation of the combustion gases and directing the combustion gas energy directly onto the first piston riser head 105.

Timing and ignition controls are located such that the first piston riser 104 controls the timing of ignition of the fuel source in the combustion chamber.

Finally, the first engine housing 101 couples to first engine mounts 130. First engine mounts 130 couple the engine 100 to a location or to an object so that the engine 100 may further couple to a device needing mechanical power.

Referring now to FIGS. 2 thru 6, this collection of figures illustrates operational positions of certain components of the engine during the operational cycle. In FIGS. 2-6, the movement of combustion gases is indicated by the directional arrow. Beginning with FIG. 2, combustion of the fuel source occurs in the combustion chamber 112 (not shown in FIG. 2), the resultant expansion of combustion gases resulting from the combustion process is directed into the combustion gas inlet 111. At this stage, the first backstop valve 110 remains in position A, preventing the combustion gases from bypassing the first piston riser head 105 of the first piston riser 104 through the first exhaust outlet 114. As such, the engine 100 begins a power stroke as the combustion gases exert their energy against the first piston riser head 105, rotating the first rotatable piston 103 and the driveshaft 106 about the driveshaft axis 107 (not shown in FIG. 2).

Figure 2:
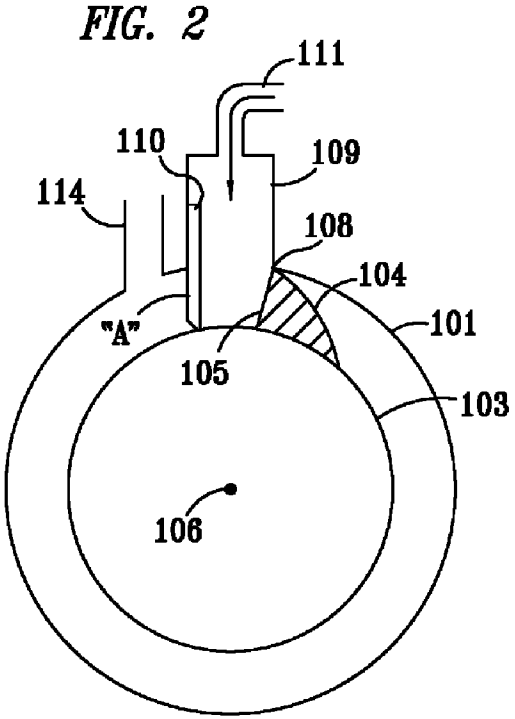
FIGS. 2-6 are schematic views of the external combustion engine as taken along viewing line 2 of FIG. 1.
Figure 3:
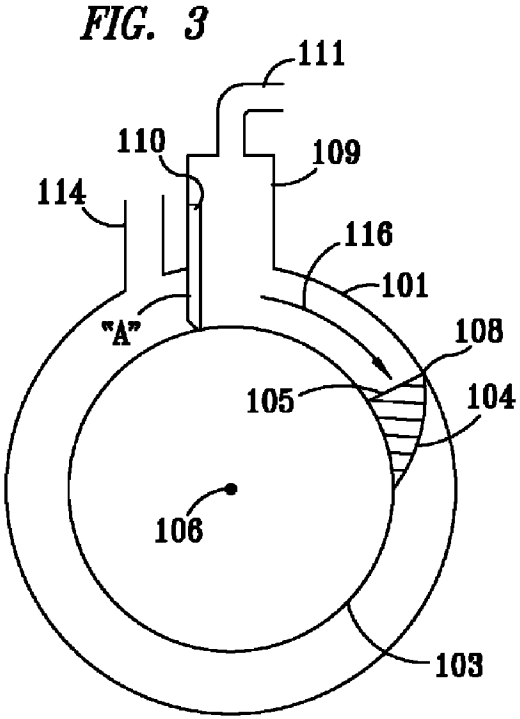
Figure 4:
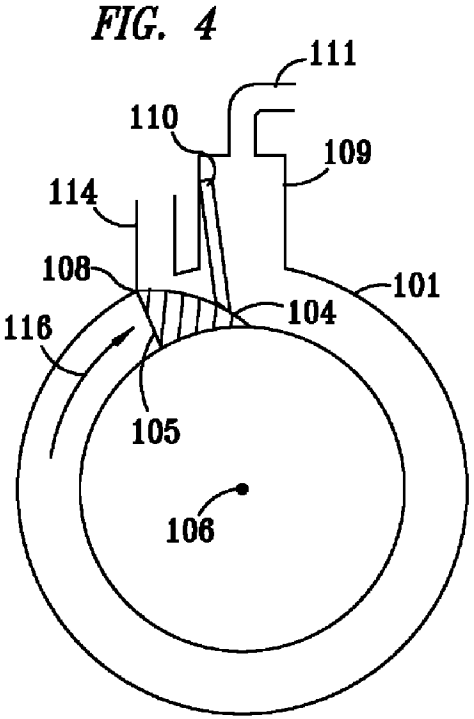

Moving now to FIG. 3, there is shown continued movement of the first rotatable piston 103, due to the force exerted by the expansion of the combustion gases against the first piston riser head 105. As the process continues, the combustion gases rotate the first rotatable piston 103 such that the first piston riser 104 lifts the first backstop valve 110. The beginning of this process is illustrated in FIG. 4. The first piston riser 104 is sized such that the first backstop valve 110 will move to close off the combustion gas inlet chamber 109, preventing the combustion gases from passing back into the combustion chamber. At this stage, the last remaining expansive energy resulting from combustion is maintained against the first piston riser head 105 due to the first piston riser 104 blocking the first exhaust outlet 114. Preferably, the first piston riser 104 is sloped such that the transition of the first backstop valve 110 from position A as illustrated in FIGS. 2 and 3 to position B as illustrated in FIG. 5 does not generate undue force on either the first backstop valve 110, or the first piston riser 104, thus prolonging the life of both elements.

Figure 5:
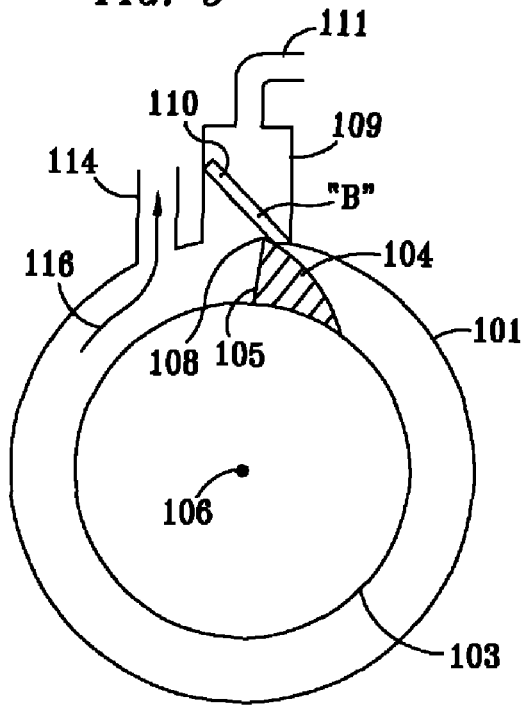
Figure 6:
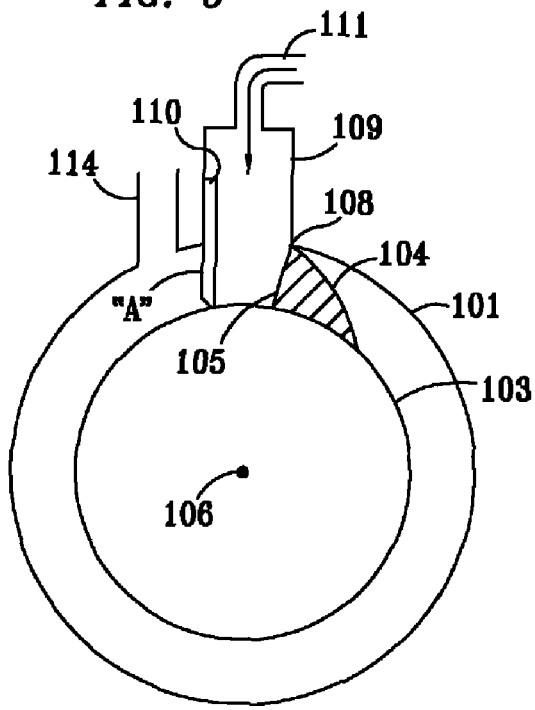

Referring now to FIG. 5, as the first rotatable piston 103 continues to rotate about the driveshaft axis 107 (not shown in FIG. 5), the first piston riser 104 pushes the first backstop valve 110 fully into position B barring passage of combustion gases from a face of the first piston riser head 105 into the combustion gas inlet chamber 109. Furthermore, as the first piston riser 104 completes a revolution, it begins to decrease the volume available for the combustion gases used at the start of the cycle. These used combustion gases are pushed through the first exhaust outlet 114. As shown in FIG. 6, once the first piston riser 104 completes its revolution, the backstop valve moves back to position A, at this point the cycle begins anew with combustion of additional fuel in the combustion chamber 112 (not shown in FIG. 6).

Figure 7:
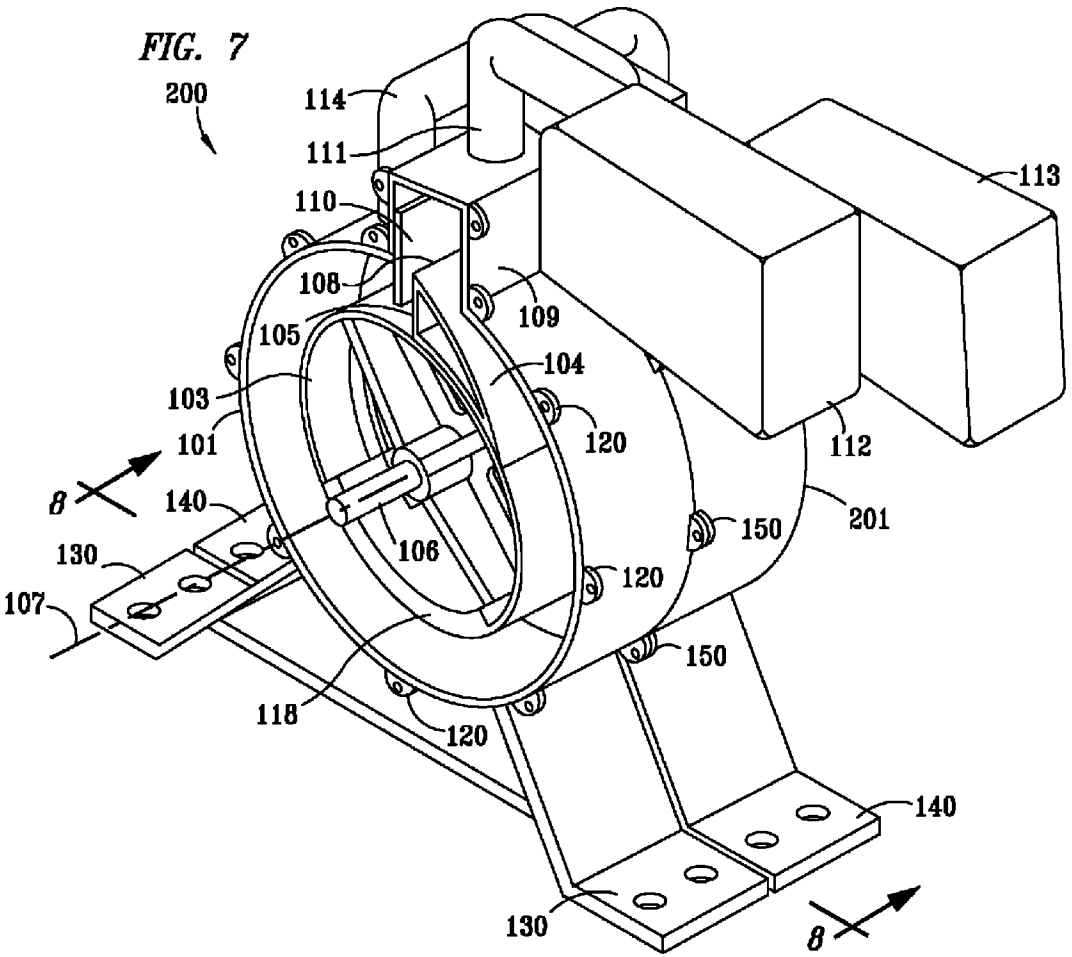
FIG. 7 is a perspective view of the external combustion engine incorporating a second stage of combustion in accordance with features of the present invention.

Referring now to FIG. 7, an engine 200 comprises the first engine housing 101 coupled to a second engine housing 201. The first engine housing 101 couples to the second engine housing 201 at engine housing flanges 150. As illustrated, the first exhaust outlet 114 directs the used combustion gases from the first engine housing 101 into the second engine housing 201 at a location which allows combustion gases to pass from the first engine housing 101 to the second engine housing 201 after combustion gases have expanded and caused the rotation of the first rotatable piston 103. Thus, the combustion gases enter a second stage (described below) allowing the external combustion engine to process the effects of combustion a second time, increasing the efficiency of the motor for each act of combustion.

All components of the engine 100 described above with respect to FIGS. 1-6 and illustrated in FIG. 7 retain their numerical designation in the engine 200 and operate as previously described. Similar to the first engine housing 101 described above, the second engine housing 201 couples to second engine mounts 140. Second engine mounts 140 allow the engine 100 to couple to a location or device so that the engine 200 may couple to a device needing mechanical power.

Figure 8:
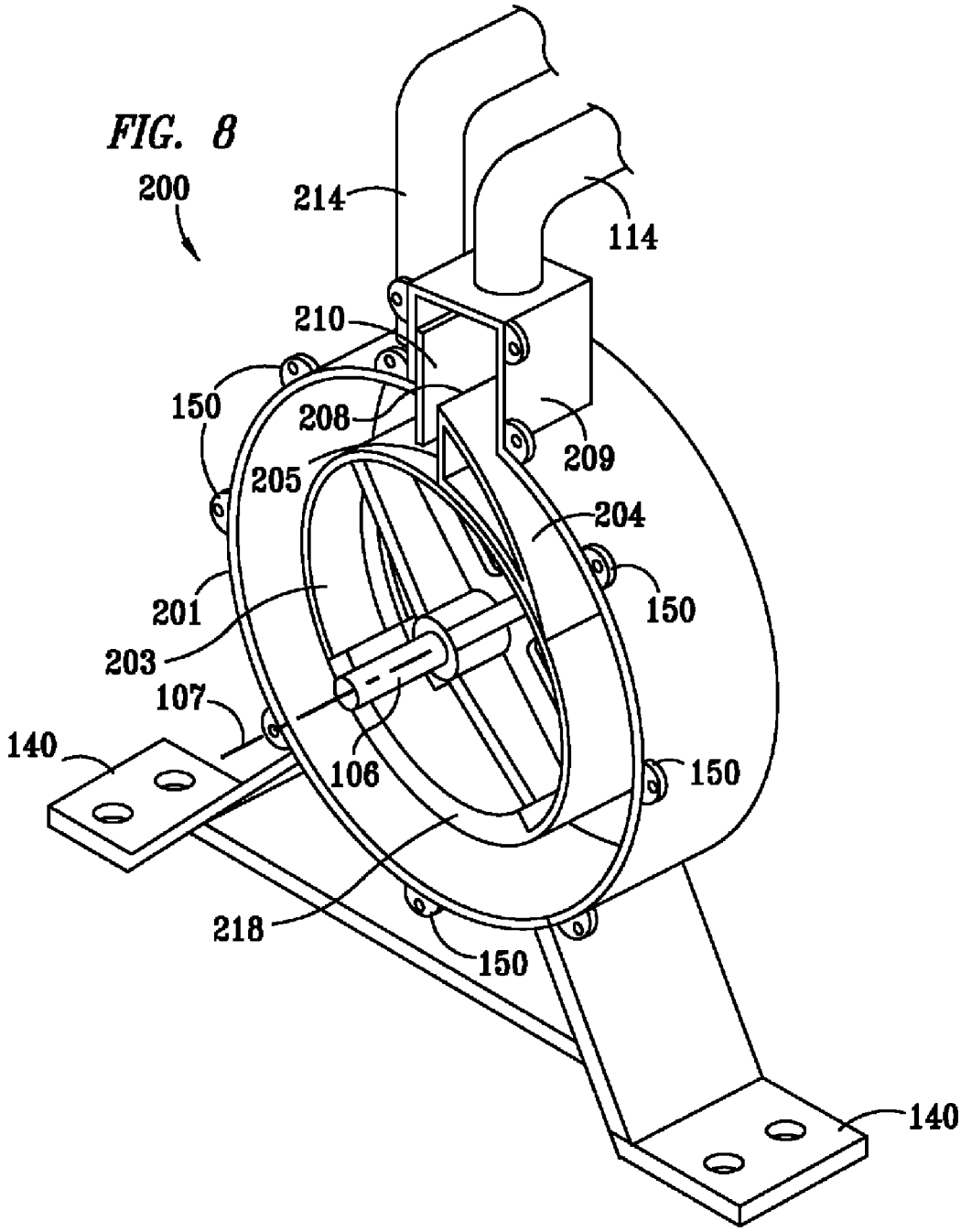
FIG. 8 is a perspective view of the second stage of the external combustion engine taken along line 8-8 of FIG. 7.

Referring to FIG. 8 of the drawings, the second engine housing 201 defines an engine chamber in which additional components of the engine 200 reside and allows those components to move in a rotational manner, as described in more detail below. A person of ordinary skill in the relevant art will understand that the second engine housing 201 may vary in shape and size provided that the second engine housing 201 defines a cavity in which appropriately sized components may operate as described herein. Furthermore, a person of ordinary skill will understand that the second engine housing 201 may be produced of a variety of materials provided that those materials are selected to appropriately accommodate any desired fuel sources with which the engine 100 is used.

The engine 200 further comprises a second rotatable piston 203. In the illustrated embodiment, the driveshaft 106 shown in FIG. 1 passes into a center of the second engine housing 101 such that the driveshaft 106 may turn on a driveshaft axis 107 passing through a length of the driveshaft 106, as illustrated in FIG. 8. A person of ordinary skill in the art will understand that the driveshaft 106 may comprise one driveshaft passing through both the first engine housing 101 and the second engine housing 201, or it may comprise two separate driveshafts coupled together. The second rotatable piston 203 couples to the driveshaft 106 such that rotation of the second rotatable piston 203 induces rotation in the driveshaft 106 about the driveshaft axis 107. The second rotatable piston 203 may vary in diameter. Preferably, a gap remains between the second rotatable piston 203 and the second engine housing 201.

The second rotatable piston 203 comprises a second piston riser 204 and a second piston riser head 205. The second piston riser 204 couples to the second rotatable piston 203 and substantially fills the gap between the second rotatable piston 203 and the second engine housing 201. The second piston riser head 205 comprises a portion of the second piston riser 204 configured to receive a force generated by the combustion of a fuel and an oxidizer (described in more detail below). The second piston riser head 205 comprises a second piston riser head edge 208. The second piston riser 204 couples to the second rotatable piston 203 such that the second piston riser head edge 208 contacts the second engine housing 201, or a seal (not shown) between the second engine housing 201 and the second piston riser head edge 208. This prevents the passage of gases and other materials between the second piston riser head edge 208 and the second engine housing 201. For ease of explanation, only one piston riser is shown in FIG. 8. A person of ordinary skill in the art will understand that multiple piston risers may couple to the second rotatable piston 203.

The second engine housing 201 further comprises an exhaust gas inlet chamber 209. The exhaust gas inlet chamber 209 comprises a portion of the second engine housing 201 configured to direct the exhaust gases exhausted from the first engine housing 101 toward the second piston riser head 205. The exhaust gas inlet chamber 209 may vary in size and location according to the use to which the engine 200 is put. The exhaust gas inlet chamber 209 further comprises a second backstop valve 210. In the illustrated embodiment, the second backstop valve 210 comprises a rigid flap hinged at one end so that the second backstop valve 210 will extend into the portion of the second engine housing 201 where the second rotatable piston 203 resides. Preferably, an edge of the second backstop valve 210 will contact the second rotatable piston 203 or a seal (not shown) between the second backstop valve 210 and the second rotatable piston 203 when the second piston riser 204 is not causing the operation of the second backstop valve 210 as described below. The second backstop valve 210 displaces into the exhaust gas inlet chamber 209 allowing the second piston riser 204 to rotate about the driveshaft axis 107 in the second engine housing 201.

The first exhaust gas outlet 114 of FIG. 1 couples to the exhaust gas inlet chamber 209.

A second exhaust outlet 214 couples to the second engine housing 201. The second exhaust outlet 214 provides a pathway for combustion gases to exit the second engine housing 201 following the completion of the engine cycle (described in more detail below). A second engine housing plate (not shown) couples to the second engine housing 201 at engine housing flanges 150. In this manner, the presently exposed interior of the second engine housing 201 is sealed from the atmosphere preventing the dissipation of the combustion gases and directing the combustion gas energy directly onto the second piston riser head 205.

Referring to FIGS. 9-13, this collection of figures illustrates operational positions of certain components of the engine 100 during the operational cycle of the second stage described above with respect to FIGS. 7 and 8. In FIGS. 9-13, the movement of combustion gases is indicated by the directional arrow. Initially, the engine completes the cycle illustrated in FIGS. 2-6 generating exhaust gases from the first engine housing 101 (not shown). Beginning with FIG. 9, exhaust gases exhausted from the first engine housing 101 (not shown) pass through the first exhaust gas outlet 114 and into the exhaust gas inlet chamber 209. At this stage, the second backstop valve 210 remains closed preventing the exhaust gases from moving away from the second piston riser head 205 of the second piston riser 204. As such, the engine 100 begins a power stroke as the exhaust gases exert their energy against the second piston riser head 205, rotating the second rotatable piston 203 and the driveshaft 106 about the driveshaft axis 107.

Figure 11:
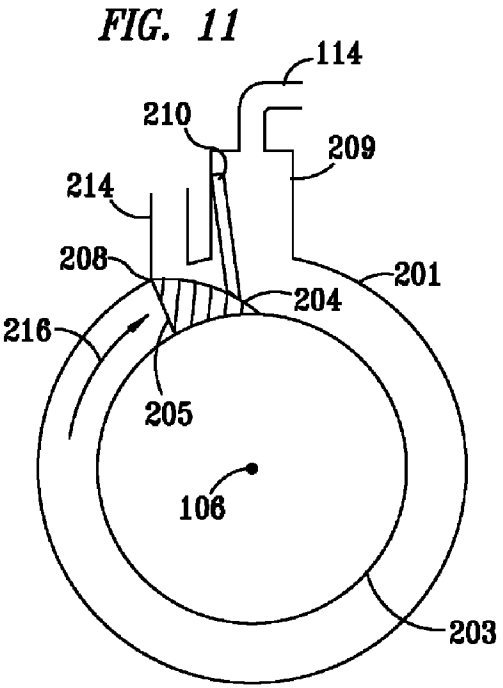
FIGS. 9-13 are schematic views of the external combustion engine as taken along viewing line 3 of FIG. 8.
Figure 10:
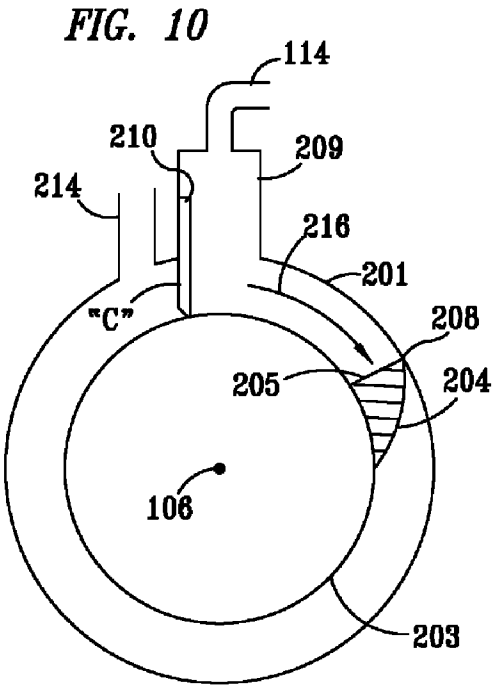
Figure 9:
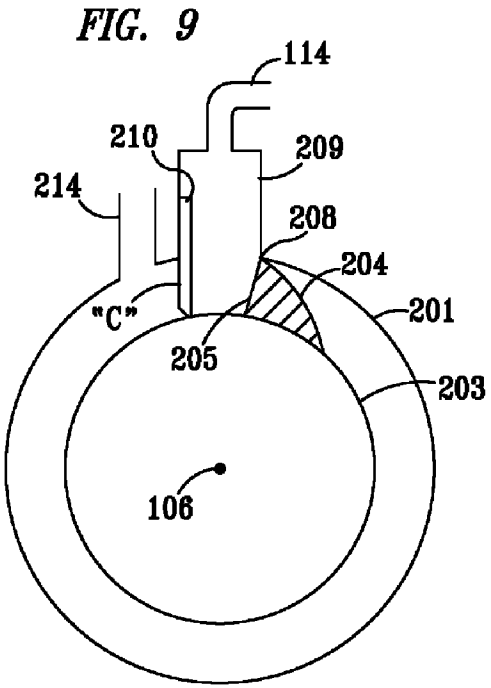

Moving now to FIG. 10, there is shown continued movement of the second rotatable piston 203, due to the force exerted by the expansion of the exhaust gases against the second piston riser head 205. As the process continues, the exhaust gases rotate the second rotatable piston 203 such that the second piston riser 204 lifts the second backstop valve 210. The beginning of this process is illustrated in FIG. 11. The second piston riser 204 is sized such that the second backstop valve 210 will close off the exhaust gas inlet chamber 209, preventing the exhaust gases from bypassing the second piston riser head 205 through the second exhaust outlet 214. At this stage, the last remaining expansive energy resulting from combustion is maintained against the second piston riser head 205 due to the second piston riser 204 blocking the second exhaust outlet 214. Preferably, the second piston riser 204 is sloped such that the transition of the second backstop valve 210 from position C as illustrated in FIGS. 9 and 10 to position D as illustrated in FIG. 12 does not generate undue force on either the second backstop valve 210, or the second piston riser 204, thus prolonging the life of both elements.

Figure 12:
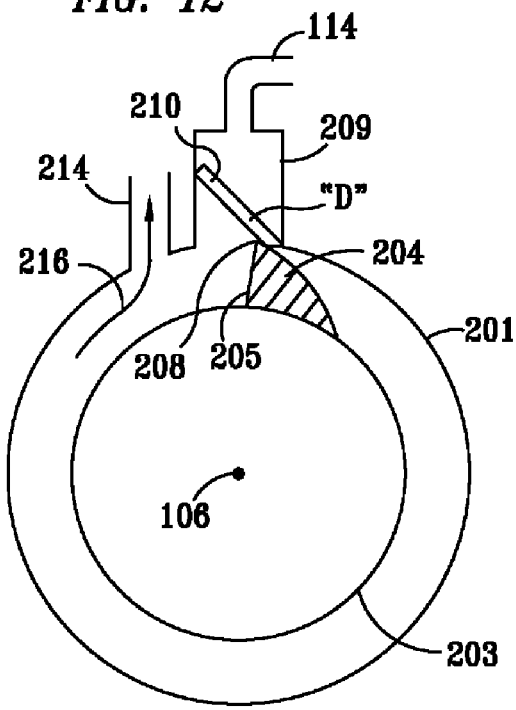
Figure 13:
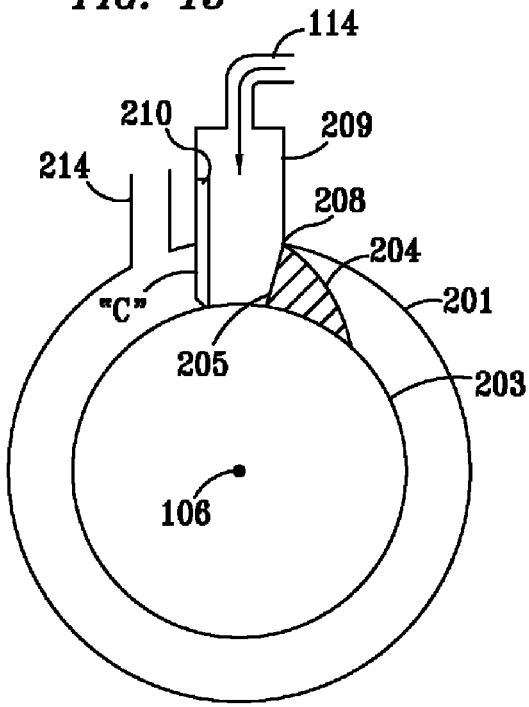
Figure 14:
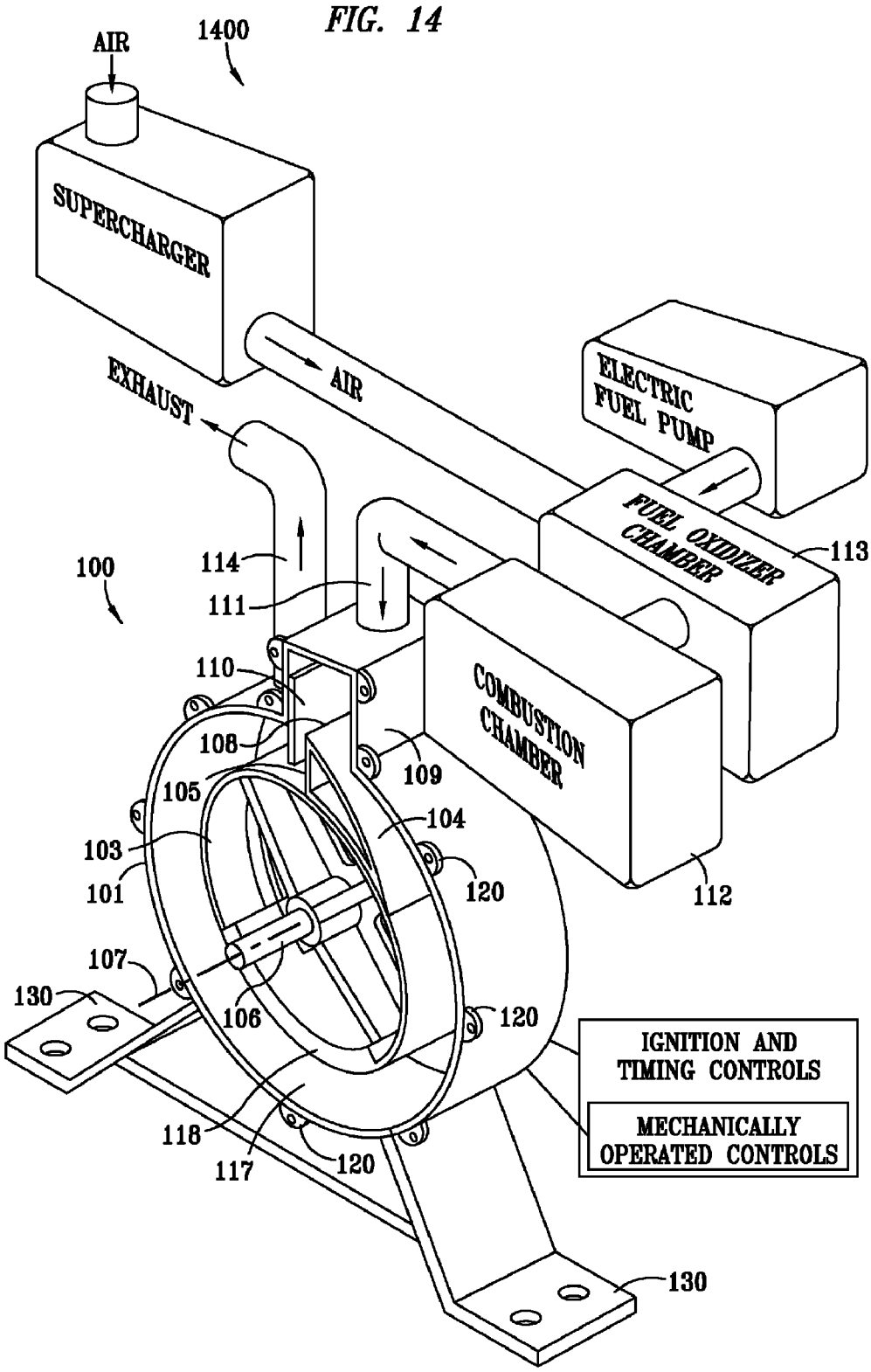
FIG. 14 is a perspective view of an external combustion engine utilizing a supercharger in accordance with principles of the present invention.

Referring now to FIG. 12, as the second rotatable piston 203 continues to rotate about the driveshaft axis 107, the second piston riser 204 pushes the second backstop valve 210 shut, barring passage of exhaust gases from a face of the second piston riser head 205 into the exhaust gas inlet chamber 209. Furthermore, as the second piston riser 204 comes close to completing a revolution, it begins to decrease the volume available for the exhaust gases used at the start of the cycle. These used exhaust gases are pushed through the second exhaust outlet 214 by the continued rotation of the second rotatable piston 203. As shown in FIG. 13, once the second piston riser 204 completes a revolution, the second backstop valve moves back to position D, at this point the cycle begins anew with entry of new exhaust gases into the exhaust gas inlet chamber 209 from the first exhaust outlet 114.

By the use of the present invention, numerous advantages are produced over prior art engines. For example, prior art internal combustion engines must operate at high pressures, and the components must be extremely strong, necessitating heavy overbuilt components, or lightweight expensive components. The engine of the present invention operates at lower operating pressures; thus, there is no need for heavy components that decrease the efficiency and use of the engine, or lightweight components that drive up the cost of the engine limiting the number of applications to which it can reasonably be applied. Furthermore, lower operating pressures allow a single embodiment of the present invention to operate at varying pressures on varying fuel sources, necessitating only minor modifications to timing and ignition to transition the engine from a first fuel source, to a second fuel source that is incompatible with the first fuel source. Finally, the present invention operates without the need of a crankshaft, or camshaft; thus, the engine operates without the need for traditional components of the internal combustion engine which significantly reduce the efficiency of the engine. Without these drags on efficiency, the engine of the present invention significantly increases the amount of power that can be produced from the same volumetric consumption of fuel.

It is understood that the present invention may take many forms and embodiments. Accordingly, several variations may be made in the foregoing without departing from the spirit or scope of the invention. For example, the size, location, and number of combustion chambers, and pistons may vary and be tailored to individual applications of the engine. Furthermore, the engine may be operated at varying operating pressures and on varying fuel sources.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An external combustion engine comprising:

a first engine housing defining a first engine chamber, wherein said first engine chamber defines an interior surface and comprises a space for containing and directing expansive gas generated by combustion of a fuel;

a combustion chamber coupled to said first engine housing such that expanding gas produced by said combustion of said fuel passes from said combustion chamber into said first engine housing through a combustion gas inlet;

a driveshaft positioned within said first engine housing, said driveshaft extending from a center of said first engine housing and passing through a wall of said first engine housing for coupling said external combustion engine to devices;

wherein said driveshaft rotates about a driveshaft axis passing lengthwise through a center of said driveshaft;

a first rotatable piston positioned within said first engine housing, said first rotatable piston including a first piston riser extending fixedly from said first rotatable piston to abut said interior surface of said first engine chamber, said first rotatable piston being coupled to said driveshaft and configured to rotate about said driveshaft axis when expansive gas resulting from said combustion of said fuel contacts said first piston riser of said first rotatable piston;

a first backstop valve extending into said first engine chamber and coupled to said first engine housing such that said first backstop valve directs expansive gas resulting from said combustion of said fuel toward said first rotatable piston;

wherein said first piston riser contacts said first backstop valve to close said combustion gas inlet;

wherein said first engine housing further defines a first exhaust outlet configured to exhaust used expansive gas resulting from said combustion of said fuel; and ignition and timing controls coupled to said first engine housing and configured to combust said fuel.

2. The external combustion engine of claim 1, wherein said first rotatable piston comprises: said backstop valve positioned in the path of said first piston riser, said path being defined as said first rotatable piston and said first piston riser rotates about said driveshaft axis; and a first piston riser head defined on said first piston riser and configured for abutting said interior surface of said first engine chamber.

3. The external combustion engine of claim 1, wherein said external combustion engine further comprises a combustion gas inlet chamber coupled to said first engine housing and configured to direct expanding gas generated by said combustion of said fuel to said first rotatable piston.

4. The external combustion engine of claim 3, wherein said first backstop valve comprises a swing valve coupled to said combustion gas inlet chamber, extending into said first engine chamber, and configured to pass combustion gas toward said first rotatable piston.

5. The external combustion engine of claim 1, wherein said first backstop valve comprises a swing valve coupled to said first engine housing, extending into said first engine chamber, and configured to pass combustion gas toward said first rotatable piston.

6. The external combustion engine of claim 1, wherein said external combustion engine further comprises an air fuel mixing tank coupled to said external combustion engine such that an air fuel mixture passes from said air fuel mixing tank into said combustion chamber.

7. The external combustion engine of claim 6, wherein said external combustion engine further comprises an electric fuel pump coupled to said external combustion engine such that said electric fuel pump pumps fuel into said air fuel mixing tank.

8. The external combustion engine of claim 6, wherein said external combustion engine further comprises a turbocharger mechanically coupled to said external combustion engine such that exhaust gas exiting said external combustion engine operates a turbine to intake and pressurize outside air before directing said outside air into said air fuel mixing tank.

9. The external combustion engine of claim 6, wherein said external combustion engine further comprises a supercharger coupled to said external combustion engine such that said supercharger intakes and pressurizes outside air before directing said outside air into said air fuel mixing tank.

10. The external combustion engine of claim 1, wherein said ignition and timing controls further comprise mechanically operated controls coupled to said first engine housing and configured to initiate said combustion based on the rotation of said first rotatable piston.

11. The external combustion engine of claim 1, wherein said external combustion engine further comprises a second stage comprising:

a second engine housing defining a second engine chamber, wherein said second engine chamber comprises a space for containing and directing expansive gas generated by combustion of a fuel;

wherein said second engine housing further defines an exhaust gas inlet;

said first exhaust outlet coupled to said exhaust gas inlet such that expansive gases exhausting from said first engine housing pass into said second engine housing;

said driveshaft positioned within said second engine housing, said driveshaft extending from a center of said second engine housing and passing through a wall of said second engine housing for coupling said external combustion engine to said devices;

a second rotatable piston positioned within said second engine housing, coupled to said driveshaft, and configured to rotate about said driveshaft axis when expansive gas resulting from said combustion of said fuel contacts said second rotatable piston;

a second backstop valve coupled to said second engine housing such that said second backstop valve directs exhaust gas resulting from said combustion of said fuel toward said second rotatable piston;

wherein said second engine housing further defines a second exhaust outlet configured to exhaust used expansive gas resulting from said combustion of said fuel; and said ignition and timing controls configured to control operation of said second stage.

12. An external combustion engine comprising:

a first engine housing defining at least one first engine chamber, wherein said at least one first engine chamber comprises a space for containing and directing expansive gas generated by combustion of a fuel;

at least one combustion chamber coupled to said first engine housing such that expanding gas produced by said combustion of said fuel passes from said at least one combustion chamber into said first engine housing through a combustion gas inlet;

a driveshaft positioned within said first engine housing, said driveshaft extending from a center of said first engine housing and passing through a wall of said first engine housing for coupling said external combustion engine to devices;

wherein said driveshaft rotates about a driveshaft axis passing lengthwise through a center of said driveshaft;

at least one first rotatable piston positioned within said first engine housing, said at least one first rotatable piston including at least one first piston riser extending fixedly from said at least one first rotatable piston to abut said interior surface of said at least one first engine chamber, said at least one first rotatable piston being coupled to said driveshaft and configured to rotate about said driveshaft axis when expansive gas resulting from said combustion of said fuel contacts said at least one first piston riser of said at least one first rotatable piston;

at least one first backstop valve extending into said at least one first engine chamber and coupled to said first engine housing such that said at least one first backstop valve directs expansive gas resulting from said combustion of said fuel toward said at least one first rotatable piston;

wherein said at least one first piston riser contacts said at least one first backstop valve to close said combustion gas inlet;

wherein said first engine housing further defines at least one first engine exhaust outlet configured to exhaust used expansive gas resulting from said combustion of said fuel; and ignition and timing controls coupled to said first engine housing and configured to combust said fuel.

13. The external combustion engine of claim 12, wherein said at least one first rotatable piston comprises:

said at least one first backstop valve positioned in the path of said at least one first piston riser, said path being defined as said at least one first rotatable piston and said at least one first piston riser rotates about said driveshaft axis; and at least one first piston riser head defined on said at least one first piston riser and configured for abutting said interior surface of said at least one first engine chamber.

14. The external combustion engine of claim 12, wherein said external combustion engine further comprises at least one combustion gas inlet chamber coupled to said first engine housing and configured to direct expanding gas generated by said combustion of said fuel to said at least one first rotatable piston.

15. The external combustion engine of claim 14, wherein said at least one first backstop valve comprises a swing valve coupled to said at least one combustion gas inlet chamber, extending into said at least one first engine chamber, and configured to pass combustion gas toward said at least one first rotatable piston.

16. The external combustion engine of claim 12, wherein said at least one first backstop valve comprises a swing valve coupled to said first engine housing, extending into said at least one first engine chamber, and configured to pass combustion gas toward said at least one first rotatable piston.

17. The external combustion engine of claim 12, wherein said external combustion engine further comprises an air fuel mixing tank coupled to said external combustion engine such that an air fuel mixture passes from said air fuel mixing tank into said at least one combustion chamber.

18. The external combustion engine of claim 17, wherein said external combustion engine further comprises an electric fuel pump coupled to said external combustion engine such that said electric fuel pump pumps fuel into said air fuel mixing tank.

19. The external combustion engine of claim 12, wherein said ignition and timing controls further comprise mechanically operated controls coupled to said first engine housing and configured to initiate combustion based on the rotation of said at least one first rotatable piston.

20. The external combustion engine of claim 12, wherein said external combustion engine further comprises a second stage comprising:

a second engine housing defining a second engine chamber, wherein said second engine chamber comprises a space for containing and directing expansive gas generated by combustion of said fuel;

wherein said second engine housing further defines an exhaust gas inlet;

said at least one first engine exhaust outlet coupled to said exhaust gas inlet such that expansive gases exhausting from said first engine housing pass into said second engine housing;

said driveshaft positioned within said second engine housing, said driveshaft extending from a center of said second engine housing and passing through a wall of said second engine housing for coupling said external combustion engine to said devices;

at least one second rotatable piston positioned within said second engine housing, coupled to said driveshaft, and configured to rotate about said driveshaft axis when expansive gas resulting from said combustion of said fuel contacts said at least one second rotatable piston;

at least one second backstop valve coupled to said second engine housing such that said at least one second backstop valve directs exhaust gas resulting from said combustion of said fuel toward said at least one second rotatable piston;

wherein said second engine housing further defines at least one second engine exhaust outlet configured to exhaust used expansive gas resulting from said combustion of said fuel; and said ignition and timing controls configured to control operation of said second stage.

* * * * *